US005580270A

United States Patent [19]

Pantland et al.

[11] Patent Number: 5,580,270

[45] Date of Patent: Dec. 3, 1996

[54] ELECTRICAL PLUG CONNECTOR

[75] Inventors: Robert M. Pantland, Gloucester; Stuart J. Reeves, Cheltenham, both of United Kingdom

[73] Assignee: Krone AG, Berlin Zehlendorf, Germany

[21] Appl. No.: 439,197

[22] Filed: May 11, 1995

Related U.S. Application Data

[63] Continuation of Ser. No. 141,863, Oct. 22, 1993, abandoned.

[30] Foreign Application Priority Data

Nov. 16, 1992 [GB] United Kingdom ..... 9224024.1

[51] Int. Cl.[6] ..... H01R 4/24

[52] U.S. Cl. ..... 439/395; 439/676

[58] Field of Search ..... 439/395, 405, 439/894, 894.1, 676

[56] References Cited

U.S. PATENT DOCUMENTS 4,850,887 7/1989 Sugawara ..... 439/894.1
5,186,647 2/1993 Denkmann .
5,226,835 7/1993 Baker III, et al. ..... 439/894.1
5,310,363 5/1994 Brownell et al. ..... 439/894.1

FOREIGN PATENT DOCUMENTS 0445376 11/1990 European Pat. Off. .

*Primary Examiner*—David L. Pirlot
*Attorney, Agent, or Firm*—McGlew and Tuttle

[57] ABSTRACT

The invention relates to a plug connector for the telecommunication and data technique comprising RJ contacts disposed in a housing and insulation displacement contacts and contact strips connecting the latter. The object of the present invention, namely to improve an electrical plug connector of the type referred to hereinbefore such that its electrical parameters are substantially improved and satisfy the requirements for the transmission of high data rates, is achieved by that the contact strips are multiply and differently angled between the RJ contacts and the insulation displacement contacts, and are at least in the contact tongue area, in part not guided in one plane parallely to each other.

12 Claims, 6 Drawing Sheets

ELECTRICAL PLUG CONNECTOR

This is a file wrapper continuation application of application Ser. No. 08/141,863, filed Oct. 22, 1993, now abandoned.

FIELD OF THE INVENTION

The invention relates to an electrical plug connector for the telecommunication and data fields and more particularly to an electrical plug connector with insulation displacement contacts for connecting electrical wires or electrical cables and RJ contacts for connection to an RJ type jack.

BACKGROUND OF THE INVENTION

A plug connector of the type referred to hereinbefore is known in the art from U.S. Pat. No. 5,074,804 (corresponding to EP 0,445,376 A1). This plug connector includes a housing with a receiving chamber for the plug, a first set of contacts according to the insulation displacement technology, and a second set of contacts (RJ contacts) connected with this first set, made of elongated contact strips inserted into grooves of the upper housing portion and guided closely to each other and parallely right into the receiving chamber, whereinto the plug (RJ plug) can be inserted. The contact strips are guided over long parallel paths and at small distances from each other, which results in a capacitance effect being generated between the contact tracks, leading to poorer values of crosstalk attenuation.

In U.S. Pat. No. 5,186,647, an electrical plug connector for applications in the field of high-frequencies is described, also having parallel contact tracks being each bent-off and disposed relative to each other such that they in part cross each other. By this measure, a reduction of the values of crosstalk attenuation is achieved, without, however, guaranteeing the required values for voice or data transmission over transmission paths with 100 megabits/s or in the frequency region of about 100 MHz. resp.

SUMMARY AND OBJECTS OF THE INVENTION

It is therefore the object of the invention to improve an electrical plug connector of the type referred to hereinbefore such that its electrical parameters are substantially improved and satisfy the requirements for the transmission of high data rates.

According to the invention, an electrical plug connector is provided for telecommunication applications or data transfer applications. The electrical plug includes a housing with RJ contacts therein. Insulation displacement contacts are also provided with contact strips extending between contact tongues of the insulation displacement contacts and the RJ contacts. The contact strips are multiple and differently angled between the RJ contacts and the insulation displacement contacts. The contact strips are also not guided in one plane parallel to each other in an area of the contact tongues.

According to another aspect of the invention, means for affecting the capacitance are disposed between the contact strips. Further, the contact strips are preferably embedded and guided in guide webs. The contact strips partly cross each other. In the crossing area of the contact strips, the guide webs preferably have interruptions.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
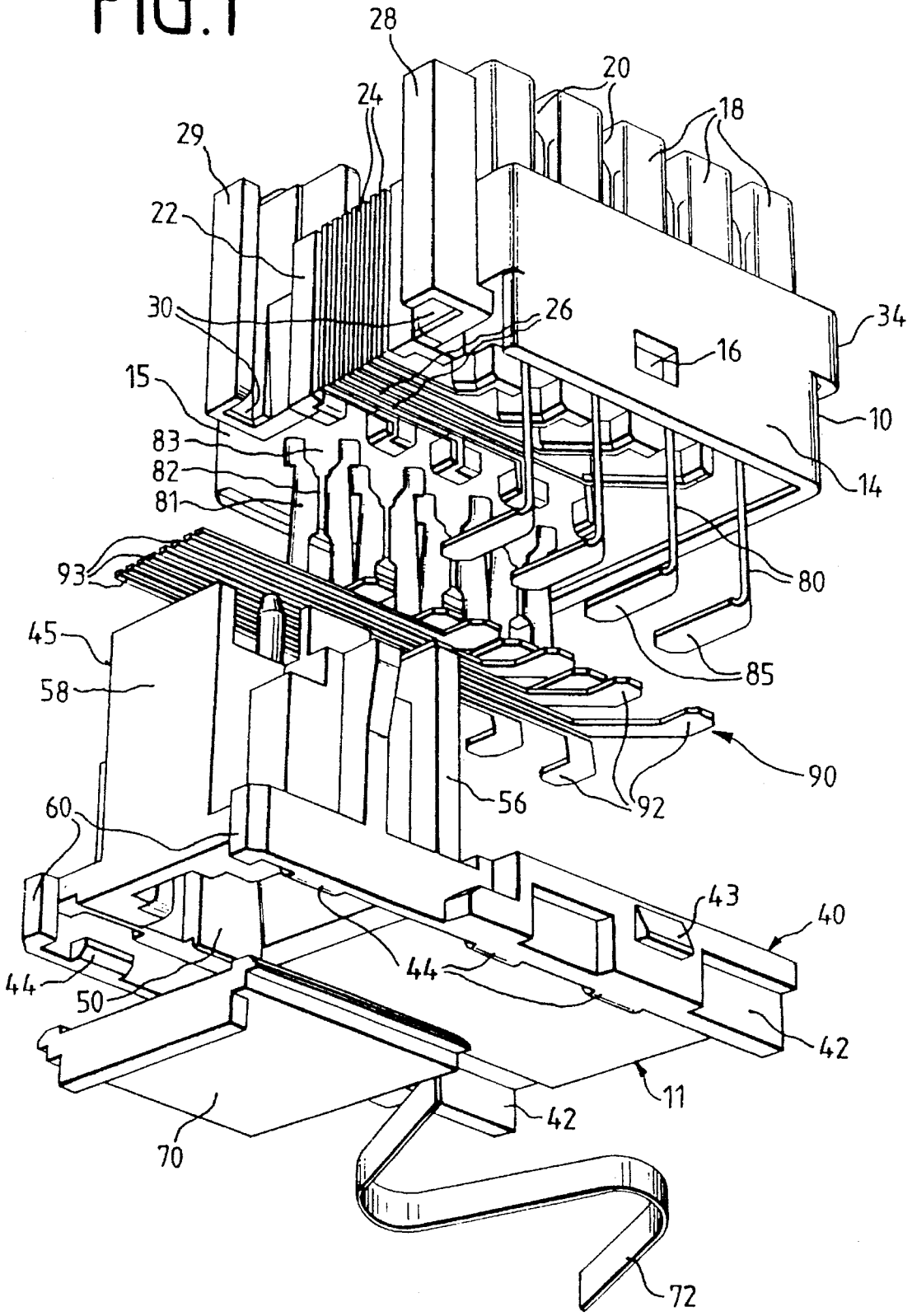
FIG. 1 is an exploded view of a plug connector as known in the art from U.S. Pat. No. 5,074,804 (corresponding to EP 0,445,376 A1)

The plug connector known in the art from U.S. Pat. No. 5,074,804 (corresponding to EP 0,445,376), according to FIG. 1, comprises a molded housing having an upper portion 10 and a lower portion 11. The upper portion 10 has opposed, substantially rectangular side walls 14, 15, each provided with a through-opening 16 for latching wedge-type projections 43 of the lower portion 11 in. On the upper side of the upper portion 10, close to each side wall 14, 15, extend two rows of column-type extensions 18 forming clamping elements, between which slots 20 are formed receiving—as will be described below—electrically conductive connection elements 80 with integrally formed, angled, flat foot sections 85. The front-side end wall 22 of the upper portion 10 is provided with a row of parallel grooves 24, being in connection with similar grooves 26 formed in the lower wall of the upper portion 10. Each of the grooves 26 extends up to closely to the lower part of a slot 20 defined by the column-type extensions 18. The front-side end wall 22 comprises, further, opposed, molded-in and angled, flange-type side portions 28, 29, forming each a channel 30. At the opposed front side, the upper portion 10 is provided with integrated hooks 34 forming clamping elements for electrical conductors.

The lower portion 11 is provided with a substantially flat end section 40 having opposed side walls 42, the outside surfaces of which are provided with wedge-type projections 43. On the inner side of each side wall 42 are provided inwardly directed flanges 44. The front end portion 45 of the lower portion 11 includes a molded-in part defining a hollow space 50 for receiving a plug, such as a plug disposed at the tail of a cord coming from a telephone set or a computer terminal. Close to the first end section 40, approximately in the center of the lower portion 11, opposedly disposed, upright columns 56 are formed. The lower portion 11 comprises, on its front, a plane wall 58 uprightly extending in a height of approximately the height of the columns 56. The other end of the wall 58 terminates at projecting portions 60 of each of the side walls 42. The lower portion may receive a closure cover 70 being disposed between the opposed side walls 42 and held in position by the flanges 44. The closure cover may be displaced between a position, wherein it blocks access to the hollow space 50, and a position, wherein the hollow space 50 is open. A spring 72 is attached at the closure cover 70, in order to pre-tension it towards the closed position.

The set of eight electrical connection elements 80 extend into the slots 20 in the upper portion 10 formed by the column-type extensions 18. Each of the connection elements 80 is provided with an insulation displacement contact element 81 having a fork-type shape and defining a relatively narrow contact slot 82 terminating in a wide insertion section 83. The arrangement is adapted such that, when inserting an electrically insulated conductor into the insertion section 83, and when pressing the conductor into the narrow contact slot 82, and when pressing the conductor into the narrow contact slot 82, the insulation of the conductor will automatically be cut-in, so that a contact between the central core of the conductor and the material of the connection element 80 will be established. The insulation displacement contact elements 81 are substantially flat and are disposed at an angle of approximately 45° to a line through the column-type extensions 18, i.e. at 45° to the plane of each slot 20. Each connection element 80 is, further, provided with a foot section 85, being integrally formed with the insulation displacement contact elements 81.

A second set of connection elements 90 comprise a row of eight contact tongues 92 being welded each to a foot section 85. An elongated contact strip 93 extends from each contact tongue 92. The contact strips 93 are adapted such that they extend in parallel to each other. The contact strips 93 terminate as RJ contacts in a receiving portion for the RJ plugs of terminals not shown in detail.

The prior art plug connector is to be considered as an 8-wire/4-pair plug connector, including contacts 1 to 8 and which can be represented for example in the following configuration (FIGS. 1 to 3):

| Wires/contacts | Pair configuration |
|---|---|
| 1 and 2 | pair 2 |
| 3 and 6 | pair 3 |
| 5 and 4 | pair 1 |
| 7 and 8 | pair 4 |

Figure 3:
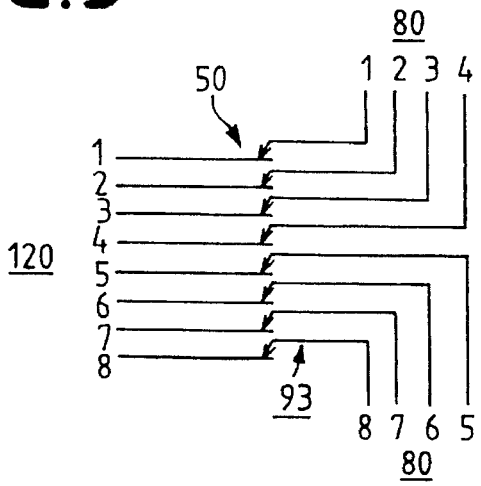
FIG. 3 is a diagrammatical representation of the line connections in the plug connector according to FIG. 1.

The eight plug contacts at position 120 in FIG. 3 are the RJ contacts and establish contact with the contact strips 93 in a plug present in the hollow space 50. The contact strips 93 extend in parallel to each other up to the connection elements 80 adapted as insulation displacement contact elements 81.

Figure 2:
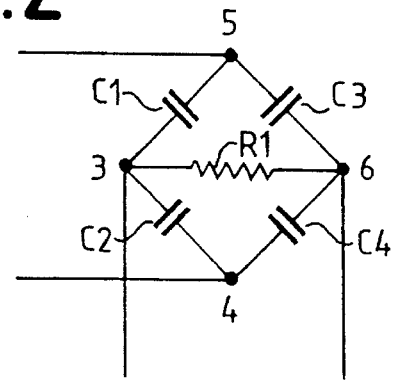
FIG. 2 is a circuit diagram showing the equivalent circuit for two contact pairs of the plug connector according to FIG. 1.

An analysis of this arrangement shows a simplistic mathematical model in that the contact pairs can be regarded as a bridge circuit. The respective equivalent circuit, e.g. for the pairs 1 and 3, is shown in FIG. 2. Therein are:

C1 the capacitance between contacts 3 and 5,

C2 the capacitance between contacts 3 and 4,

C3 the capacitance between contacts 5 and 6,

C4 the capacitance between contacts 6 and 4,

R1 the line impedance.

When the capacitance C1 between contacts 3 and 5 (FIG. 3) is defined as 1, then the capacitances C2 and C3 are each of the amount 2, and the capacitance C4 is also of the amount 1 (FIG. 2).

For avoiding crosstalk, no current must flow through resistor R1, i.e. the bridge according to the figure has to be balanced. This, in turn, requires fulfillment of the condition $$\frac{C1}{C2} = \frac{C3}{C4}$$

If, however, the bridge comprises, as shown in the example, capacitance values C1 and C4 of the amount 1, and capacitance values C2 and C3 of the amount 2, then it is distinctly imbalanced. This situation exists between pairs 1 and 3 as well as between pairs 2 and 3 and 3 and 4. The main reason for crosstalk is the capacitive imbalance between the pairs.

Crosstalk can be minimized, when the RJ contacts of a plug connector are adapted such that the capacitive imbalance is reduced, or elements are brought into connection with the contacts (an impedance across the contacts), which provide a controlled capacity and reduce thus the imbalance. The RJ contact arrangements can be organized such that not only the internal capacitive imbalance, but also the internal capacitive imbalance of each assigned, suitable plug is compensated.

Figure 4:
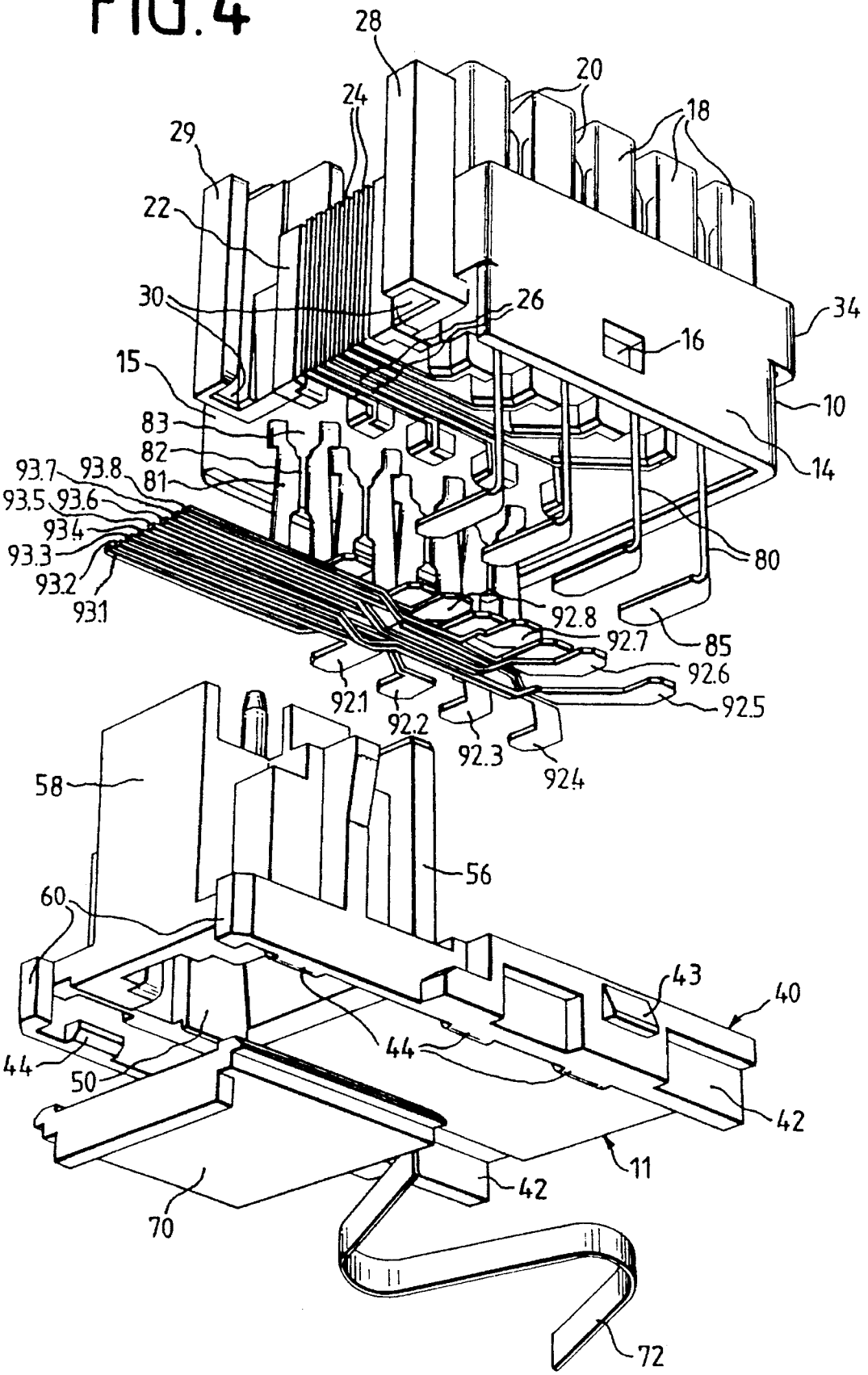
FIG. 4 is a perspective view of the plug connector according to the invention in an exploded view.

The plug connector according to the invention shown in FIG. 4 corresponds, in its construction, to the housing of the plug connector according to FIG. 1 formed of an upper portion 10 and of a lower portion 11. The contact strips 93 are adapted, however, such that they do not extend in parallel to each other, on part of their path, but are disposed in multiple angled paths from the hollow space 50 to the connection elements 80 or to the contact tongues 92, resp. The contact tongues 92 are disposed in one plane. From the plane of the contact tongues, the contact strips 93 are in part multiply angled, in the area of the contact tongues 92, towards bottom and top and also towards left or right, and in part cross each other. The RJ contact 1, e.g., is connected over its contact strip 93.1 with the contact tongue 92.2, the RJ contact 2 is connected over its contact strip 93.2 with the contact tongue 92.1, the RJ contact 3 is connected over its contact strip 93.3 with the contact tongue 92.3, the RJ contact 4 is connected over its contact strip 93.4 with the contact tongue 92.5, the RJ contact 5 is connected over its contact strip 93.5 with the contact tongue 92.4, the RJ contact 6 is connected over its contact strip 93.6 with the contact tongue 92.6, the RJ contact 7 is connected over its contact strip 93.7 with the contact tongue 92.8 with the contact tongue 92.7.

Figure 5:
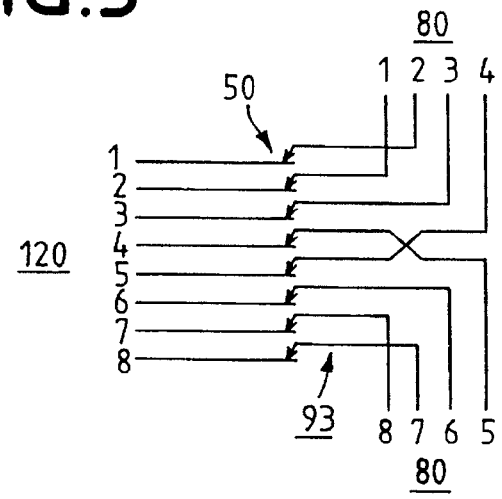
FIG. 5 is a diagrammatical representation of the line connections in the plug connector according to FIG. 4.

In FIG. 5, in a diagrammatical representation, there is shown that by such arrangement of the contact strips 93, now the capacity C1 between contacts 3 and 5 and the capacity between the RJ contacts 6 and 4 is increased, since the RJ contacts are closer together. Thereby, a compensation of the capacities is achieved. Such compensation can also be achieved by a reduction of capacities C2 and C3, by positioning the RJ contact elements 3 and 4 farther away from each other. The electrical parameters of the remaining configuration pairs can also be affected.

Figure 6:
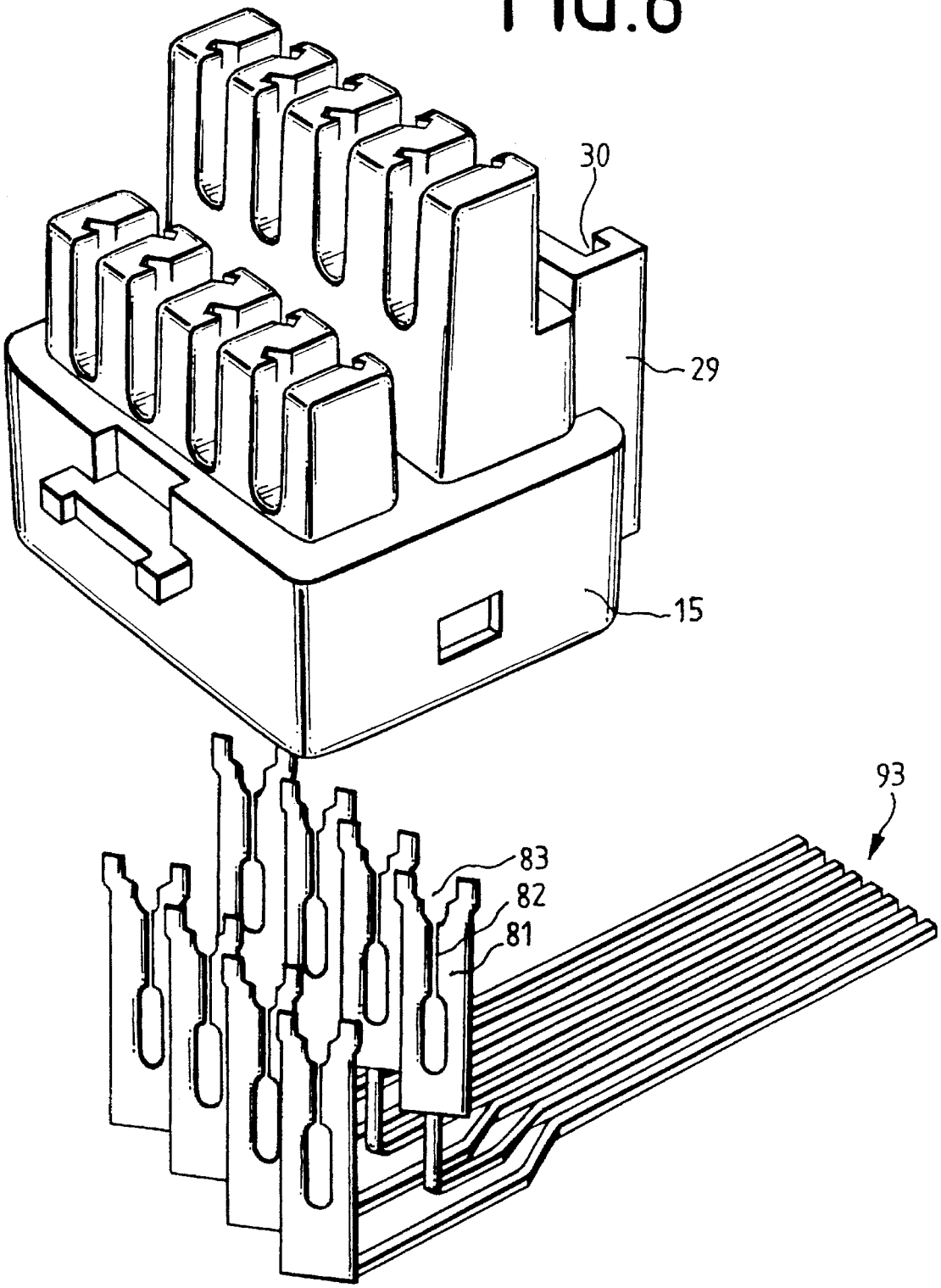
FIG. 6 is a perspective view of the second embodiment of the plug connector according to the invention according to FIG. 4 in an exploded view.

A second embodiment of the present invention is shown in FIG. 6. Therein, the housing is not shown. The contact strips 93 are angled in a different manner, and are then guided in parallel to each other.

Figure 7:
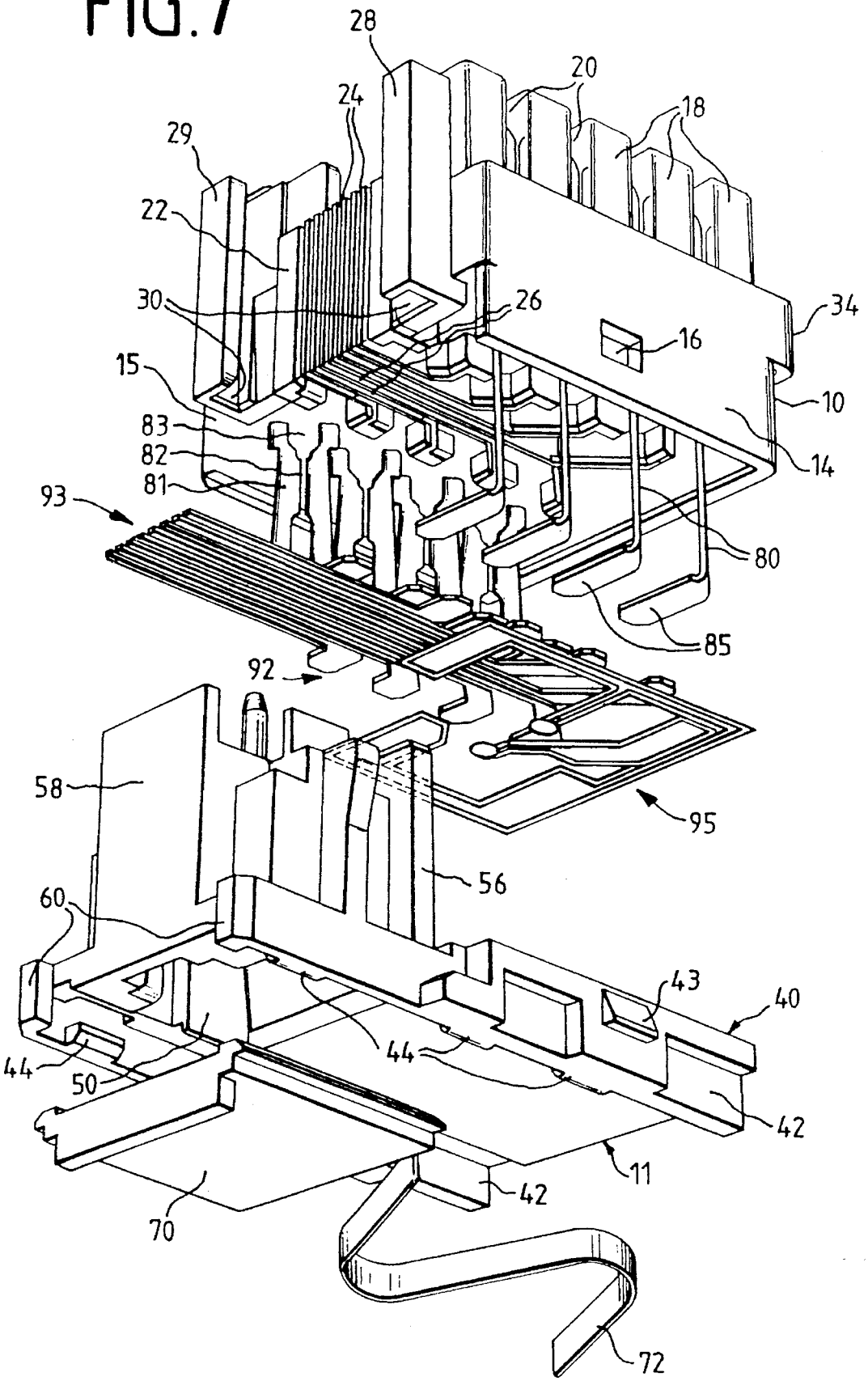
FIG. 7 is a perspective view of the third embodiment of the plug connector according to the invention according to FIG. 4 in an exploded view.

FIG. 7 shows a third embodiment of the connection elements 90, 92 according to FIG. 4. To these connection elements 90, 92 there is electrically connected a second contact element 95. This second contact element 95 can either be a printed circuit board or a metal element, such element being insulated with a high-dielectrical material. Such high-dielectrical material is positioned in certain regions on the contact element 95, in order to provide a controlled capacity to the remaining contact positions and to compensate the internal capacitive imbalance. This provides an impedance element between contact strips 93, to balance the energy flowing through the contacts, to reduce crosstalk.

Figure 8:
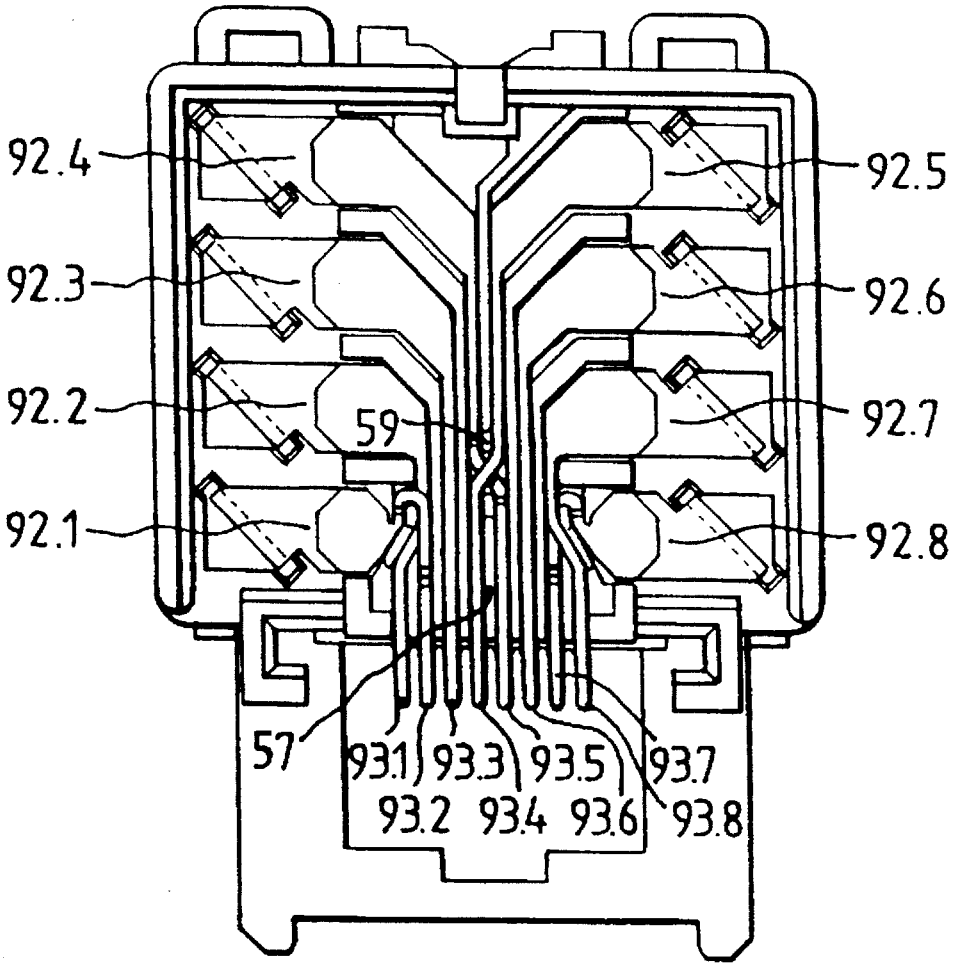
FIG. 8 is a bottom view of another configuration of the connection elements according to the present invention.

In FIG. 8, another embodiment of the connection between the contact tongues 92 and the contact strips 93 is shown. In this embodiment, the contact strips are in part crossing each other in the area of the connection to the contact tongues 92. The contact strip 93.1 is guided to the contact tongue 92.2 and crosses the contact strip 93.2 being guided to the contact tongue 92.1. The contact strip 93.3 is guided to the contact tongue 92.3 without crossing. The contact strip 93.4 is connected with the contact tongue 92.5 and crosses the connection between the contact strip 93.5 and the contact tongue 92.4. The contact strip 93.6 is connected with the contact tongue 92.6. The contact strip 93.7 is guided to the contact tongue 92.8 and is crossed by the connection between the contact strip 93.8 and the contact tongue 92.7. The contact strips 93 and the contact tongues 92 are disposed in the plug connector area in guide webs 57 of the lower housing portion 11. The guide webs 57 have interruptions 59 in the crossing area of the contact strips 93. The contact strips 93 and the contact tongues 92 are disposed in two planes at the crossing positions only, but are generally in one plane. The in part crossing contact strips 93 guided in guide webs 57 of plastic, effect a reduction of the mutual capacitive influences.

While specific embodiments of the invention have been shown and described in detail to illustrate the application of the principles of the invention, it will be understood that the invention may be embodied otherwise without departing from such principles.

What is claimed:

1. An electrical plug connector for telecommunication and data transfer applications, comprising:

a housing having a housing upper portion with a first side wall, a second side wall, a front-side end wall and a lower wall;

insulation displacement contacts positioned in said housing, including a first set of insulation displacement contacts disposed in a first row, said first row extending along said first, side wall of said housing, said first row having a front contact on an RJ plug receiving end of said housing and having a rearmost contact on an end of said housing opposite said RJ plug receiving end, a second set of insulation displacement contacts disposed in a second row, said second row extending along said second side wall of said housing, said second row having a front contract on an RJ plug receiving end of said housing and having rearmost contact on an end of said housing opposite said RJ plug receiving end;

contact strips having a contact tongue area connected to said insulation displacement contacts, said contact strips terminating in RJ contacts for connection to an RJ type plug; and crosstalk reduction means for avoiding crosstalk between said contact strips, said crosstalk reduction means being provided along said contact strips adjacent to said contact tongue area, between said first row of insulation displacement contracts and said second row of insulation displacement contacts, said crosstalks reduction means also being positioned between a first line intersecting said front contacts of said rows of insulation displacement contacts and a second line intersecting said rearmost contacts of said rows of insulation displacement contacts, said contact strips extending in parallel between said front contact of said first and second row and contact strip ends.

2. An electrical plug connector according to claim 1, wherein:

said crosstalk reduction means inches means supporting said contact strips to be multiple and differently angled between said RJ contacts and said insulation displacement contacts such that said contact strips are not guided in a single plane parallel to each other at least in an area of said contact tongues.

3. An electrical plug connector according to claim 1, wherein said crosstalk reduction means is formed by crossed pairs of said contact strips, at least one of said pairs including a contact strip connected to a contact of said first row and a contact strip connected to a contact of said second row, said contact strips with contact pads nearest said RJ contacts having a portion forming a U-bend towards a contact pad next nearest contact pad.

4. An electrical plug connector according to claim 1, wherein:

said crosstalk reduction means comprises impedance means connected between contact elements to balance energy flowing through the contact elements.

5. An electrical plug connector according to claim 4, wherein:

said impedance means comprises an additional contact element including a conductive portion insulated with a high-dielectrical material, said additional contact element being positioned adjacent to said contact strips to compensate for an internal capacitive imbalance.

6. An electrical plug connector according to claim 1, wherein:

said crosstalk reduction means comprises supporting said contact strips at a plurality of locations at which one of said contact strips extends over an adjacent contact strip.

7. An electrical plug connector according to claim 6, wherein:

said plurality of locations are provided adjacent to said contact tongues.

8. An electrical plug connector for telecommunication and data transfer applications, comprising:

a housing having a housing upper portion with a first side wall, a second side wall, a front-side end wall, a rear-side wall and a lower wall;

insulation displacement contacts positioned in said housing, including a first set of insulation displacement contacts disposed forming a row along said first side wall of said housing and a second set of insulation displacement contacts disposed forming a row along said second side wall of said housing, said first set of insulation displacement contacts and said second set of insulation displacement contacts being disposed between said front-side end wall and said rear-side end wall, each of said insulation displacement contacts having a foot section;

contact strips having a contact tongue area, each contact tongue area being positioned to contact a corresponding foot section of said insulation displacement contacts in a contact area, said contact area being in a region wherein said first set of insulation displacement contacts and said second set of insulation displacement contacts are disposed, between a plane of said front-side end wall and a plane of said rear-side wall, said contact strips terminating in RJ contact portions, extending over said front-side end wall for connection to an RJ type plug; and crosstalk reduction means for avoiding crosstalk between said contact strips, said crosstalk reduction means being provided in said contact area, between said first set of insulation displacement contacts and said second set of insulation displacement contacts and between said plane of said front side end wall and a plane of said rear-side end wall said crosstalk reduction means also being positioned between a first line intersecting front contacts of said rows of insulation displacement contacts and a second line intersecting rearmost contacts of said rows of insulation displacement contacts.

9. An electrical plug connector according to claim 8, wherein said housing includes a housing lower portion defining a hollow space for receiving an RJ plug, said housing lower portion being connected to said housing upper portion with said RJ contact portions extending into said hollow space and with a plug receiving opening extending in a direction opposite to a direction which said insulation displacement contacts extend.

10. An electrical plug connector for telecommunication and data transfer applications comprising:

a housing having a housing upper portion with a first side wall, a second side wall, a front-side end wall, a rear-side end wall and a lower wall, said housing including a housing lower portion deflating a hollow space for receiving an RJ plug;

insulation displacement contacts positioned in said housing, including a first set of insulation displacement contacts disposed forming a row along said first side wall of said housing and a second set of insulation displacement contacts disposed forming a row along said second side all of said housing, said first set of insulation displacement contacts and second set of insulation displacement contacts being disposed between said front-side end wall and said rear-side end wall, each of said insulation displacement contacts having a foot section;

contact strips having a contact tongue area, each contact tongue area being positioned to contact a corresponding foot section of said insulation displacement contacts in a contact area, said contact area being in a region wherein said first set of insulation displacement contacts and said second set of insulation displacement contacts are disposed, between said front-side end wall and said rear-side end wall, said contact strips terminating in RJ contact portions, extending over an outer portion of said front-side end wall for connection to an RJ type plug; and crosstalk reduction means for avoiding crosstalk between said contact strips, said crosstalk reduction means being provided in said contact area, between said first set of insulation displacement contacts and said second set of insulation displacement contacts said crosstalk reduction means also being positioned between a first line intersecting a front contact of said rows of insulation displacement contacts and a second line intersecting a rearmost contact of said rows of insulation displacement contacts.

11. An electrical plug connector according to claim 10, wherein said housing lower portion is connected to said housing upper portion with said RJ contact portions extending into said hollow space and with a plug receiving opening extending in a direction opposite to a direction which said insulation displacement contacts extend.

12. An electrical plug connector according to claim 10, wherein said crosstalk reduction means is formed by staggered crossed pairs of said contact strips, at least one of said pairs including a contact strip connected to a contact of said first row and a contact strip connected to a contact of said second row, said crosstalk reduction means being positioned between ends of said rows of said insulation displacement contacts.

* * * * *